US005086818A

United States Patent [19]

Bendt

[11] Patent Number: 5,086,818

[45] Date of Patent: Feb. 11, 1992

[54] BEVERAGE STORAGE AND DISPENSING DEVICE

[76] Inventor: Larry A. Bendt, 6584 Rustic Dr., Parker, Colo. 80134

[21] Appl. No.: 574,463

[22] Filed: Aug. 27, 1990

Related U.S. Application Data

[63] Continuation-in-part of Ser. No. 315,325, Feb. 24, 1989.

[51] Int. Cl.[5] ..... B65B 3/04

[52] U.S. Cl. ..... 141/358; 141/98; 141/351; 141/354; 141/362; 224/42.45 R; 224/42.41; 62/371

[58] Field of Search ..... 141/98, 291, 351, 352, 141/353, 354, 355, 357, 358, 360, 361, 362; 224/42.45 R, 42.46 R, 42.43, 42.44, 42.41, 273, 281, 42.01; 62/371, 389, 457.1

[56] References Cited

U.S. PATENT DOCUMENTS

| | | | |
|---|---|---|---|
| 1,362,831 | 12/1920 | Altenberg | 141/360 |
| 2,399,787 | 5/1946 | Clerc | 62/371 X |
| 2,903,024 | 9/1959 | Lohse | 141/358 Xa |
| 2,915,082 | 12/1959 | Shaw | 224/42.45 R |
| 2,933,225 | 4/1960 | Fry et al. | 224/42.46 R |
| 3,411,552 | 11/1968 | Love | 141/360 |
| 4,054,037 | 10/1973 | Yoder | 62/371 |
| 4,130,149 | 12/1978 | Hausam | 141/358 |
| 4,166,487 | 9/1979 | Spies | 141/358 |
| 4,232,718 | 11/1980 | Wipperman | 141/358 |
| 4,303,109 | 12/1981 | Cohen | 141/98 |

*Primary Examiner*—Ernest G. Cusick
*Attorney, Agent, or Firm*—John L. Isaac

[57] ABSTRACT

A beverage storage and dispensing device is disclosed and includes a housing having top, bottom, front and rear surfaces. A liquid storage chamber is disposed within the housing for storing a beverage including insulation for maintaining the temperature of the beverage within the storage chamber. An inlet is provided for introducing the beverage into the storage chamber, and a mechanism is provided for mounting the housing in an upright position. An arrangement is provided for selectively dispensing beverage from the storage chamber into a liquid receiver device including an orifice defined in the bottom surface of the housing and extending into the storage chamber. A closure device slidingly moves between a first position wherein the orifice is covered and a second position wherein the orifice is uncovered to permit selective passage of beverage by gravity flow therethrough. A seal is provided to prevent leakage when the closure device is in the first position, and a bias member urges the closure device toward the first position. Finally, a trigger mechanism selectively operates the closure device in opposition to the bias member to permit flow of beverage through the orifice in the second position.

26 Claims, 5 Drawing Sheets

10
12
14
16
18
20
22
24
26
28
30
32
38
40
42
44
64
66
70
72
74
76
78
80
100
102
104
106
108
110
112
114

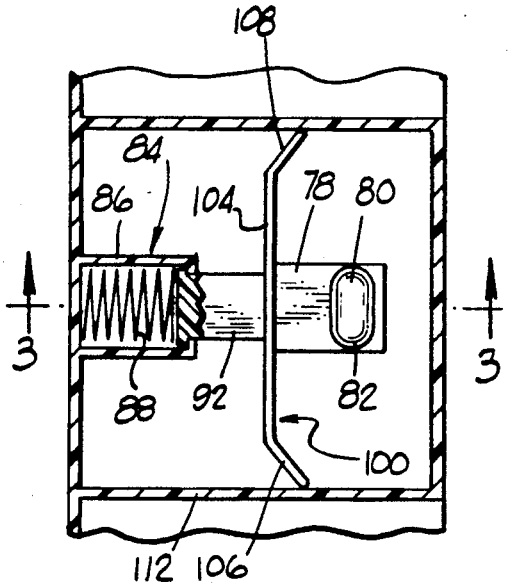
FIG. 2
FIG. 3A
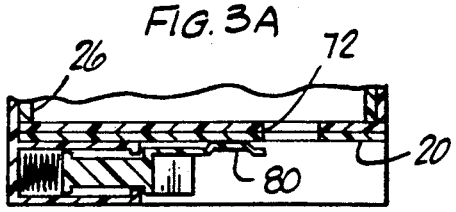
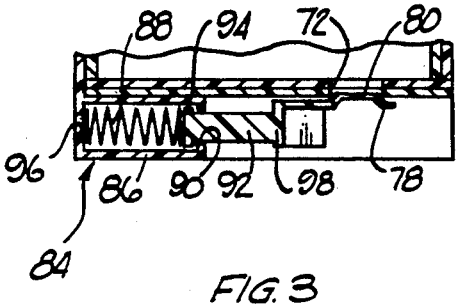
FIG. 3
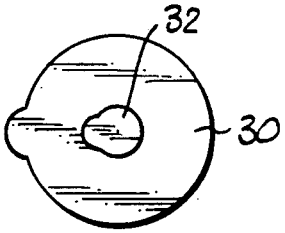
FIG 4
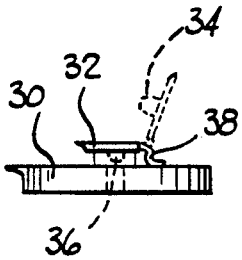
FIG. 5
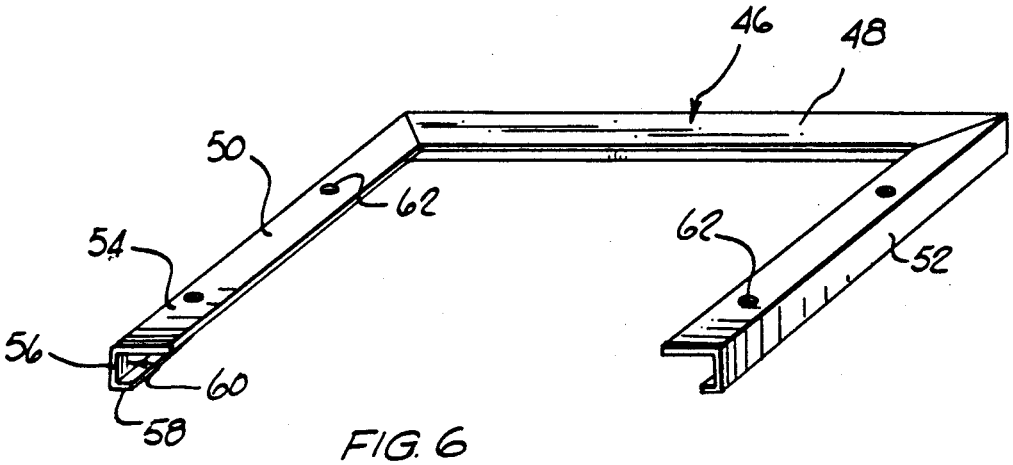
FIG. 6

BEVERAGE STORAGE AND DISPENSING DEVICE

RELATED APPLICATIONS

This application is a Continuation-in-Part of U.S. Patent application Ser. No. 07/315,325, filed Feb. 24, 1989.

BACKGROUND OF THE INVENTION

1. Field of the Invention

The present invention relates generally to beverage containers and, more particularly, to portable insulated containers for hot or cold liquids. Specifically, the present invention relates to a beverage container having an improved dispensing device adapted for one hand operation.

2. Description of the Prior Art

Insulated beverage containers are well known in the art. Such containers include sophisticated cooling apparatus such as disclosed in U.S. Pat. Nos. 4,054,037 and 2,399,787. Such containers also include simple thermally insulated containers which are well known in the art. For the typical use, thermal beverage containers have generally included an exterior plastic housing or bottle lined with an interior container made from glass, plastic, or the like. This interior container also provides a thermal barrier in order to maintain the temperature of the liquid placed within the container, whether that temperature be warm or cool. Such passive thermal insulated beverage containers are very efficient for short term periods such as in automobile commuting, daily travel, lunch containers, picnic containers, and the like.

The traditional thermal container includes a bottle-shaped container with a glass or plastic lining having a screw-type top which is used for both filling the container as well as for removing the contents from the container. The disadvantage with this type of device is particularly apparent when the user of the device is traveling in a vehicle or the like. In such instances, the possibility of spillage of hot or cold liquid onto the person who is pouring from the container to a liquid receiver such as a cup is obvious.

To overcome such difficulties, certain types of dispensing mechanisms have been utilized with insulated containers. The traditional picnic jug includes a spigot extending from the side of the liquid container, which arrangement requires the depressing of a button by the finger of the operator. U.S. Pat. No. 4,303,109 discloses a beverage dispenser device with holder particularly adaptable for automobiles and the like. This particular holder includes a bottle-shaped container which is oriented upside-down. It includes a button at the cap thereof for dispensing liquid from the container into a cup. The button must be operated by the user and generally anticipates the user holding the cup with one hand while dispensing the liquid using the opposite hand. While one-hand maneuvering and manipulation of the device illustrated in this patent would be possible, the potential for spillage in a moving vehicle is particularly high if the user is the operator and only occupant of the vehicle.

Therefore, there remains a need for a thermally insulated beverage container which may be operated with the use of one hand and which is particularly suited for use in a moving vehicle with operation by the vehicle operator being in a manner so as to prevent leakage and spillage and as to avoid the necessary use of both hands, which is an unsafe condition.

SUMMARY OF THE INVENTION

Accordingly, it is one object of the present invention to provide a beverage storage and containing device suitable for use in moving vehicles.

It is another object of the present device to provide a thermally insulated beverage container having an improved dispensing mechanism.

Yet another object of the present invention is to provide a thermally insulated beverage container and dispenser which is suited for one-hand operation, with reduced leakage and spillage potentials.

In accordance with the above and other objects and advantages of the present invention, a beverage storage and dispensing device is disclosed and includes a housing having top, bottom, front and rear surfaces. A liquid storage chamber is disposed within the housing for storing a beverage including insulation for maintaining the temperature of the beverage within the storage chamber. An inlet is provided for introducing the beverage into the storage chamber, and a mechanism is provided for mounting the housing in an upright position. An arrangement is provided for selectively dispensing beverage from the storage chamber into a liquid receiver device including an orifice defined in the bottom surface of the housing and extending into the storage chamber. A closure slidingly moves between a first position wherein the orifice is covered and a second position wherein the orifice is uncovered to permit selective passage of beverage by gravity flow therethrough. A seal is provided to prevent leakage when the closure device is in the first position, and a bias member urges the closure device toward the first position. Finally, a trigger mechanism selectively operates the closure device in opposition to the bias member to permit flow of beverage through the orifice in the second position.

BRIEF DESCRIPTION OF THE DRAWINGS

FIG. 2 is a top plan view, with some parts of section, of one trigger mechanism of the present invention.

FIG. 3 is a cross-sectional view, taking substantially along Line 3—3 of FIG. 2.

FIG. 3A is a view similar to that of FIG. 3 but illustrating the dispensing mechanism of FIG. 3 in an open position.

FIG. 4 is a top plan view of the inlet cap of the present invention.

FIG. 5 is a side view, with some parts in shadow, of the cap of FIG. 4.

FIG. 6 is a top perspective view of a mounting bracket useful in mounting the embodiment illustrated in FIG. 1.

DETAILED DESCRIPTION OF THE PREFERRED EMBODIMENTS

Figure 1:
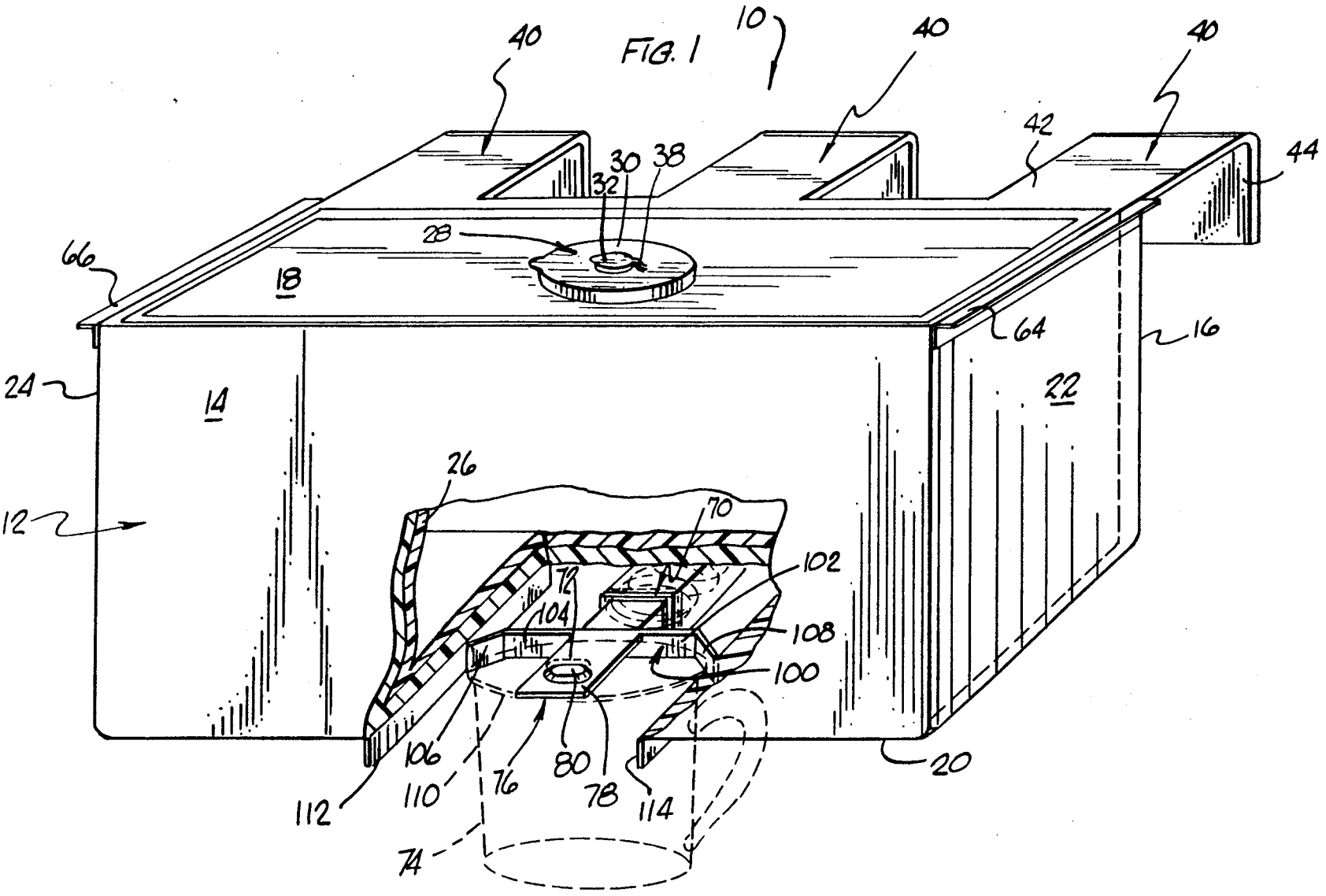
FIG. 1 is a front perspective view, with some parts broken away, of one embodiment of the present invention.

Referring to the Figures, and particularly to FIG. 1, a beverage container 10 containing an insulating device is illustrated. The container 10 includes an outer housing 12 which has a front surface 14, a rear surface 16, a top surface 18, a bottom surface 20, and two side surfaces 22, 24. While the housing 12 may be of a desired shape and form, the illustrated device is a preferred form and is substantially rectangular in shape, preferably dimensioned 4" in height, 4" in depth, and 12" in width. This particular size is especially suitable for use in vehicles such as automobiles and the like for reasons to be described further below.

The housing 12 may be constructed from any desired material and is preferably constructed from molded plastic. The housing 12 contains an inner chamber or container 26, which is adapted for receiving and storing liquid therein. The inner chamber 26 is shaped in the same manner as the housing 12 and is dimensioned to be form fitted within the housing 12. The inner chamber 26 may be constructed from any thermally insulated material such as plastic, foam, glass, and the like. The preferred form of construction is that of ⅛th inch thermally insulated plastic to provide an interior thermal barrier to maintain the temperature of the liquid within the chamber 26, whether that temperature be an elevated temperature for hot liquids such as coffee and the like or a cooled temperature for soft drinks, milk, and the like.

Referring to FIGS. 1, 4, and 5, an inlet 28 is provided on the top surface 18 of the housing 12. The inlet 28 includes a cap member 30, which may be force fit or threaded into an aperture in the upper surface 18 and a vent cap 32. The vent cap 32 includes a center pin 34 which is adapted to fit within a small aperture 36 passing through the center of the cap 32 and the main cap 30. The aperture 36 is a vent hole to permit dispensing of the liquid from the lower portion of the container or the inner chamber 26. The cap 32 is preferably connected by a hinge 38 to the main cap 30.

The container 10 may be used in any number of environments and for any number of purposes such as for picnics, traveling and the like. A particularly useful purpose for which the invention is specifically adapted for use is within a traveling vehicle such as an automobile. It is with respect to this environment that the remainder portions of the invention as illustrated in the Figures will be described. It should be understood, however, that the present invention and dispensing mechanism thereof may be utilized in any type of beverage container and dispensing device whether or not it is particularly useful within automobiles or other moving vehicles.

Figure 8:
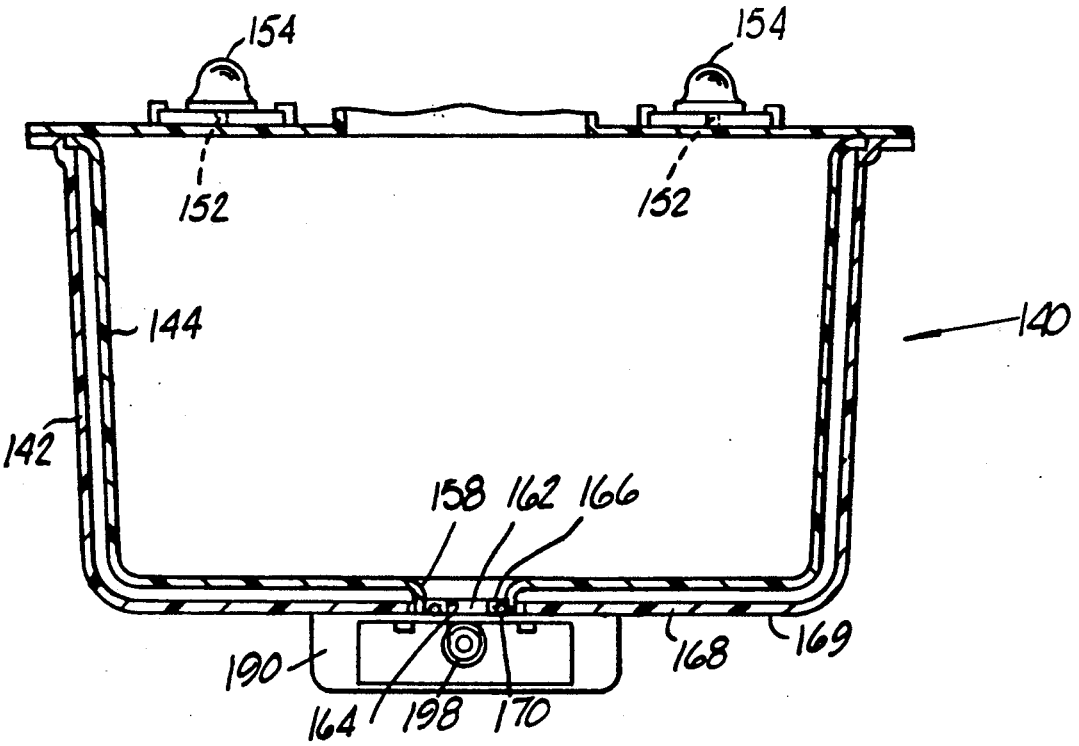
FIG. 8 is a front, sectional view taken substantially along line 8—8 of FIG. 9 and illustrating yet another embodiment of the invention.
Figure 9:
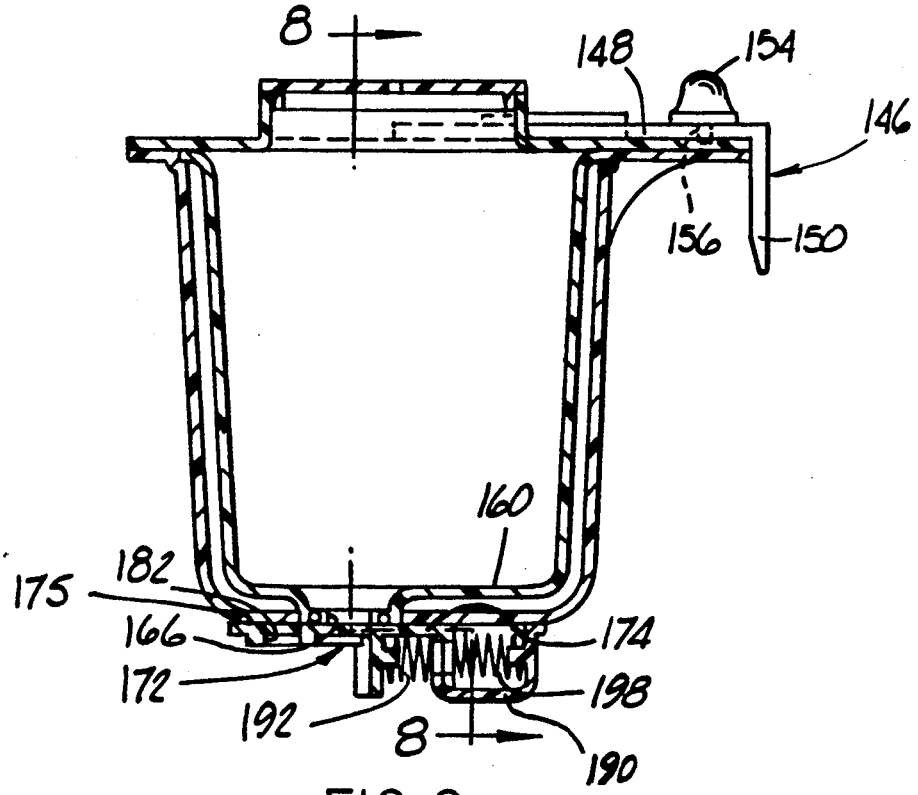
FIG. 9 is a side sectional view of an alternate embodiment of the invention.
Figure 10:
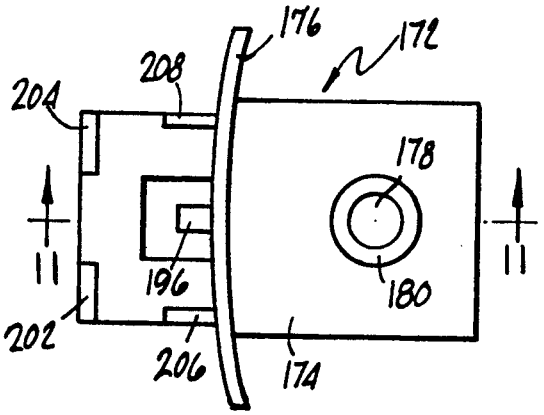
FIG. 10 is a top plan view of the slide closure used in the triggering mechanism of the embodiment illustrated in FIGS. 8 and 9.
Figure 11:
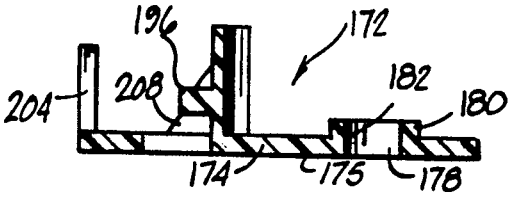
FIG. 11 is a sectional view taken substantially along line 11—11 of FIG. 10.
Figure 12:
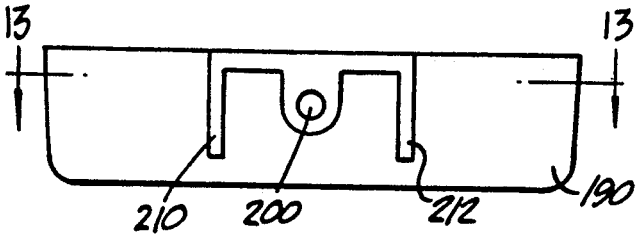
FIG. 12 is a front plan view of the triggering mechanism housing of the embodiment illustrated in FIGS. 8 and 9.
Figure 13:
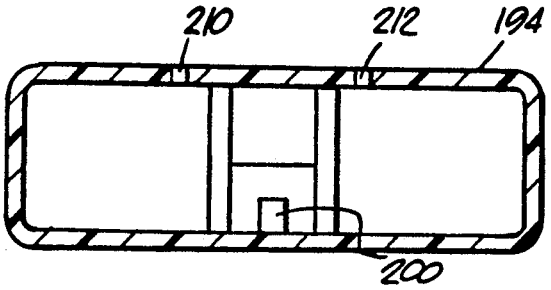
FIG. 13 is a sectional view taken substantially along line 13—13 of FIG. 12.

Referring in particular to FIGS. 1 and 6, the housing 12 is preferably mounted so that the unit 10 is portable. The unit 10 may be removed from its mounting in order to fill and refill the device 10 as well as to clean the container 26. In one form of the invention, the unit 10 is adapted for mounting onto the interior door of an automobile and includes at least one, and preferably a plurality, of brackets 40 each projecting rearwardly from the rear edge of the upper surface 18 so as to project behind the rear surface 16 of the housing 12. The brackets 40 are preferably "L"-shaped in form and include a ledge portion 42 projecting parallel with the surface 18, and a lip member 44 at the distal end of the ledge portion 42 and which projects downwardly at approximately right angles to the ledge portion 42. The bracket 40 is sized to space the housing 12 away from the center of a vehicle door such that the lip portion 44 may be inserted into the window cavity of a door between the window and the door. If a plurality of such brackets 40 are utilized, each of the brackets are so inserted into a window cavity so as to firmly hold the lip portions between the window and the door within the cavity of the door. The ledge portions 42 then project outwardly to space the housing 12 in a manner that the rear surface 16 of the housing 12 rests against the inner surface of the automobile door. FIGS. 8 and 9, described below, illustrate an adjustable form of mounting bracket.

In an alternate form from that illustrated, one elongated bracket 40 may be utilized to span the entire length of the housing 12 rather than a plurality of individual brackets 40 spaced apart as illustrated in FIG. 1. In this manner, the housing 12 may be readily installed onto a vehicle and removed from its upright mounted position within an automobile for cleaning, refilling, and the like. However, when the device 10 is in position, the housing 12 is maintained firmly in place and is not easily dislodged therefrom.

An alternate form of mounting includes a mounting bracket 46 illustrated in FIG. 6. The mounting bracket 46 includes a rear member 48 and a pair of side members 50, 52. Each side member 50, 52 is formed in the same member and includes an upper surface 54, a side surface 56, and a bottom lip 58 so as to form an interior channel 60 between the surfaces 54, 56, 58. In addition, one or more apertures 62 are disposed in the upper surface 54 of each of the side members 50, 52. Bracket 46 is provided for mounting to the lower portion of an automobile dash and the like by utilizing screws or other attachment mechanisms passing through the apertures 62 to permanently mount the bracket 46 to the dash. In utilizing this embodiment, the housing 12 includes a pair of upper shoulders 64, 66, that extend outwardly from the sides 22, 24 of the housing 12. The shoulders 64, 66 are adapted in size and shape for sliding engagement within the channels 60 of the side bracket members 50, 52. Thus, if this form of mounting is preferred, the bracket 46 is mounted to the bottom of an automobile or truck dash, the rear brackets 40 are removed, and the housing 12 is slidingly positioned within the bracket 46 by engaging the shoulders 64, 66 within the channels 60 of the respective side brackets 50, 52. In this manner, the housing 12 may be removably mounted beneath the dash of a vehicle so that it may not interfere with the operator of the vehicle. When it is desired to clean or refill the unit 10, the unit 10 is simply removed from the bracket 46.

Referring now to FIGS. 1-3, a dispensing mechanism 70 is utilized to dispense beverage from the container 26. In one preferred form, the dispensing mechanism 70 includes an orifice or duct 72 that extends through the bottom surface of the interior chamber 26 and through the bottom surface 20 of the housing 12. The orifice 72 is utilized to dispense fluid from the chamber 26 by gravity flow into a liquid receiving device 74 such as a cup, coffee mug or the like. The mechanism 70 includes a closure device 76 which is preferably in the form of a flat slide plate 78 adapted for reciprocal longitudinal movement transverse to the width dimension of the housing 12. The plate 78 moves between a first position illustrated in FIGS. 1-3 wherein the orifice 72 is covered, and a second position as illustrated in FIG. 3A wherein the duct 72 is uncovered such that beverage within the chamber 26 may flow therethrough. In one embodiment detent 80 is disposed on the upper surface of the plate 78 toward the distal end thereof and is sized and shaped to snugly fit within the exterior end opening of the orifice 72 so as to plug the orifice 72 when the plate 78 is in its first, closed position. In a preferred form, the detent 80 may also include a sealant material 82 disposed around the peripheral edges thereof in order to seal the orifice 72 and seat the detent 80 to prevent leakage therefrom.

The plate 78 is arranged relative to the bottom surface 20 of the housing 12 so as to create a slight upwardly force against the bottom surface 20 to firmly fit the detent 80 within the orifice 72 when the plate is in its first, closed position. When the plate 78 is moved to its second, open position as illustrated in FIG. 3A, the detent 80 engages the bottom surface 20 of the housing 12 so as to increase the force between the plate 78 and the housing bottom surface 20.

A bias mechanism 84 is utilized to continuously urge toward and maintain the slide plate 78 in its first closed position. The bias mechanism 84 preferably includes a housing 86 and a compression spring 88 disposed within the bias housing 86. The housing 86 includes an end opening 90 through which a plunger 92 passes. The interior end 94 of the plunger 92 is attached to one end of the spring 88 while the other end of the spring 88 is attached to the rear wall 96 of the bias housing 86. The forwardmost end 98 of the plunger 92 is secured to the plate 78 so that the plunger 92 and the plate 78 move together as an integral unit. Thus, when the plate 78 is in its first, closed position, the compression spring 88 is exerting just a slight force against the plunger 92 to maintain the plate 78 and the detent 80 in its closure position. When the plunger 92 is moved inwardly into the bias housing 86 so as to remove the detent 80 from the orifice 72 and move the plate 78 out from beneath the orifice 72 to dispense liquid, the spring member 88 is further compressed as illustrated in FIG. 3A so as to substantially increase the force urging the plate 78 back to its closed position. Thus, a constant force must be maintained against the plunger 92 in order to maintain the plate 78 in its open position. Otherwise, the compression of the spring 88 will immediately urge the plate 78 to its closed position to engage the detent 80 within the orifice 72.

In order to operate the plunger 92 and the movement of the plate 78, a trigger mechanism 100 is utilized. The trigger mechanism 100 in one embodiment preferably includes a trigger member 102 operatively connected to the plate 78 and the plunger 92 to move the plate 78 and the plunger 92 to their second, open duct position. In the illustrated embodiment, the trigger member 102 includes a ledge 104 attached to the plate 78 and the plunger 92 at its forwardmost end 98. The ledge 104 preferably includes angled end members 106, 108 so as to form a cup-like shape for receiving the lip portion 110 of a liquid receiver device 74. The trigger member 102 is positioned so as to extend between a pair of substantially parallel alignment tracks 112, 114 which are aligned transversely to the width dimension of the housing 12. The alignment tracks 112, 114 maintain the alignment of the trigger member 102 as it is moved in reciprocal fashion so as to move the plate 78 between its first and second positions. Thus, the end members 106, 108 slide against the faces of the tracks 112, 114 to maintain the position of the trigger member 102, the plate 78 and the plunger 92 relative to the bias housing 86 to ensure that the detent 80 remains in proper position. In addition, the tracks 112, 114 form a channel into which the liquid receiver device or cup 74 is moved. Thus, the trigger mechanism 100 of the present invention is adapted to be operated by a liquid receiver device 74 rather than by the hand or finger of an operator of the unit 10 as with prior art devices.

In operation, liquid is poured into the interior chamber 26 through the inlet 28, and the dispensing orifice 72 is maintained in a closed, sealed condition by the detent 80 and the closure plate 78 which are maintained in their position as a result of the bias member 84. When it is desired to dispense liquid from the chamber 26, a liquid receiver device 74, such as a coffee mug, is placed between the alignment tracks 112, 114 and positioned up against the trigger member 102. The cup 74 is then pressed against the trigger member 102 toward the bias member 84 so as to compress the spring 88 and move the plate 78 and detent 80 out from beneath the duct 72. When the detent 80 and plate 78 have been moved entirely away from the duct 72, liquid flows automatically through the orifice 72 into the liquid receiver device 74.

This operation of the device 10 may be performed with only one hand without an operator having to focus attention to the filling of the cup 74. When the desired level of liquid within the receiver device 74 is achieved, the cup 74 is then pulled back along the tracks 112, 114. The compression spring 88 automatically moves the plunger 92 and the plate 78 outwardly from the bias housing 86 so as to reengage the detent 80 within the orifice 72. This stops the flow of liquid from the chamber 26 into the cup 74. In the preferred form, the orifice 72 is located such that there is at least 0.5 inch of liquid receiver device 74 extending past orifice 72 when the orifice 72 is in its closed position. This sizing arrangement is preferred in order to prevent dripping outside the cup 74 from the duct 72 as it is being closed.

Figure 7:
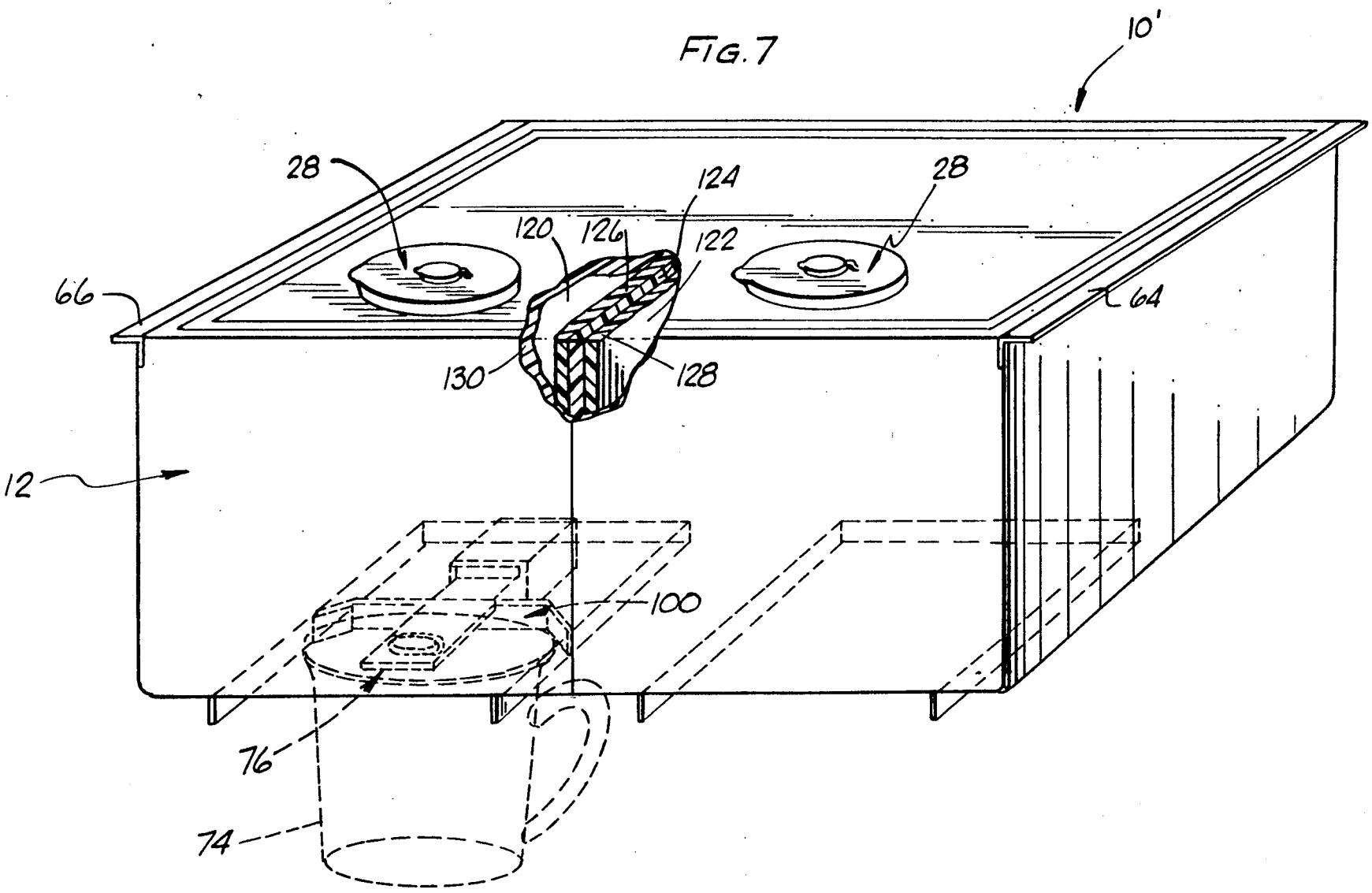
FIG. 7 is a front perspective view, with some parts in shadow and some parts broken away, of another embodiment of the present invention.

Referring now to FIG. 7, an alternate embodiment of the invention is illustrated. In this FIG. 7 illustrating the device 10', like numerals indicate like parts. In this instance, the difference between the device 10 of FIG. 1 and the device 10' of FIG. 7 is that the device 10' includes a pair of interior chambers 120 and 122 defined within the housing 12. The interior chambers 120, 122 are formed by including a center insulating member 124 which bifurcates the housing 12 into two distinct portions. Then, each chamber 120, 122 is defined by its own interior insulated material 126, 128 in addition to the exterior housing insulated material 130. Thus, each chamber 120, 122 includes double insulation as with the prior embodiment and is additionally separated from its adjacent chamber by a further layer of insulated material 124.

In this manner, each chamber 120, 122 may contain different liquids at different temperatures, for example one chamber 120 containing a hot liquid while the chamber 122 contains a cold liquid. Inlet mechanisms 28 are provided for each chamber 120, 122, and dispensing mechanisms 76 are also provided for each of the chamber 120, 122 as in the prior embodiment. The operation of the device 10' is the same as in the device 10 of FIG. 1 except that an operator or user of the device 10' has a choice of which liquid to dispense into a liquid receiving cup 74. In FIG. 7, shoulders 64, 66 are provided as with the prior embodiment for mounting the device 10' under a vehicle dash. It should be understood, however, that brackets 40 (not illustrated in FIG. 7) may also be utilized with the embodiment 10' to mount the unit 10' to an automobile door and the like.

Another embodiment of the present invention is illustrated in FIGS. 8–13. In this particular embodiment, the liquid storage and dispensing member 140 includes an outer housing 142 and an inner storage chamber 144 as in prior embodiments. In this embodiment, adjustable brackets 146 are provided. Each bracket 146 includes a ledge portion 148 aligned substantially parallel with the upper surface of the housing 142 and a lip member 150 at the distal end of the ledge portion 148 projecting downwardly at approximately right angles to the ledge portion 148. A slot 152 is disposed along a portion of the center axis of the ledge portion 148 through which an attachment mechanism 154, such as a screw or the like, may pass. An aperture 156 is contained within the upper surface of the housing 140 for receiving the attachment mechanism 154. In this manner, the attachment mechanism 154 may be loosened, and the bracket 146 may be extended outwardly or inwardly relative to the housing 142 along the slot 152 until the desired spacing between the lip member 150 and the housing 142 is achieved. Once this desired space is achieved, the attachment mechanism 154 is tightened so as to fix the relative position between the bracket 146 and the housing 142. In this manner, the device 140 may be readily mountable on the interior door of any vehicle with a simple length adjustment of the brackets 146.

In this illustrated embodiment, the interior storage chamber 144 includes a duct 158 defined in the bottom 160 thereof. In preferred form, the duct 158 is in the form of a funnel-shaped opening terminating in an orifice 162. The orifice 162 is colinear with the orifice opening 164 in the bottom portion 168 of the outer housing 142. In preferred form, a groove 166 is disposed in the exterior surface 169 of the bottom portion 168 and surrounds the orifice 164. A resilient member 170 is positioned within the groove 164. In preferred form, the groove 164 is annular in shape, and the resilient member 170 comprises an elastomeric O-ring or the like. The resilient member 170 extends or projects outwardly from the bottom surface 169 so as to have firm resilient contact with the slide closure member 172, preferably in the form of a plate, which closure member functions similarly to the closure member of the previous embodiments. In this manner, when the closure member 172 is in its first or closed position as illustrated in FIG. 9, the resilient member 170 is in firm contact against the upper surface 175 of the slide plate 174 so as to firmly engage the plate 174 and therefore seal the orifice 164 and the duct 162. This sealing process is in lieu of the detent 80 illustrated in the prior embodiments 1–7.

Referring particularly to FIGS. 9–13, it is important that the dispensed liquid be directed in a straight stream when being dispensed from the device 140. Otherwise, drops may tend to splash outside the receiving cup (not illustrated), which is undesirable. In order to assist in this manner and to prevent leakage while dispensing liquid from the device 140, the slide closure mechanism 172 has been modified in this embodiment as compared to prior embodiments. As previously discussed, the slide closure mechanism 172 includes a slide plate 174 and a trigger member 176 oriented downwardly therefrom when in use. In this embodiment, the slide plate 174 includes an aperture 178 disposed therein. The plate 174 also includes a depending collar 180 which surrounds the aperture 178 so as to form a port 182. The port 182 is designed to align itself colinearly with the orifice 164 and the duct 162 in the storage chamber 144 when the closure mechanism 172 is in its second or open position to dispense liquid form the device 140. In this manner, a tunnel or barrel comprising the duct 162 and the port 182 ensures that a straight stream of liquid is dispensed from the storage chamber 144 in a proper manner. Moreover, it prevents dribbling from the exit of the port 182, and the O-ring 170 further prevents seepage from the juncture between the closure plate 174 and the housing bottom 168 while liquid is being dispensed from the chamber 144.

A slight modification to the bias mechanism of the present invention is also illustrated in this particular embodiment. In this particular embodiment, the bias housing 190 is positioned on the bottom surface 168 of the housing 142 as in the prior embodiments. In this instance, however, there are preferably two spring mechanisms utilized in the invention. As particularly illustrated in FIGS. 9, 12 and 13, the first coiled spring 192 is disposed between the exterior surface 194 of the enclosure 190 and the rear surface of the trigger plate 176 surrounding an alignment member 196. A second coiled spring 198 is positioned within the enclosure defined by the bias housing 190 and surrounds a second alignment member 200 and engages a pair of spring-plates 202, 204 which are positioned at the end of the closure plate 174 within the bias housing 190. Thus, the two spring members 192, 198 cooperate conjointly to urge the closure plate 172 from its second, open dispensing position to its first, closed position as in the prior embodiments. Finally, a pair of alignment members 206, 208 are preferably mounted on the closure member 172 for sliding engagement within a pair of slots 210, 212 positioned in the front surface 194 of the bias housing 190. The alignment members 206, 208 ensure that the closure plate 174 remains in aligned position as it moves between its first and second positions during operation so that the port 182 always comes into colinear alignment with the duct 162 when the closure member 172 is moved to its second, dispensing position.

As can be seen from the above, the present invention provides a very useful, portable beverage container with a unique dispensing mechanism. The container of the present invention may be used to carry and dispense either hot or cold liquids and may be used within a moving vehicle mounted on a door or under a dash depending on the needs and the desires of the user of the device. The present invention provides a unique dispensing mechanism whereby an automotive vehicle operator may easily refill a cup or mug without having to take both hands off the vehicle steering wheel to use them to open and close the container as with prior devices. Moreover, the operator need not take his or her eyes off the road while operating the moving vehicle because of the alignment mechanism of the invention whereby the operator may simply position the liquid receiver device beneath the container, press the trigger mechanism with the liquid receiver device until a desired level is filled, and then simply remove the cup or liquid receiver device from beneath the dispensing mechanism without dripping or leakage.

As a result, the dispensing mechanism of the present invention provides substantial convenience and considerably enhanced safety operation of a vehicle. It also provides for a cleaner operation in that the potential for spillage or leakage is considerably reduced compared to prior art devices attempting to achieve the same function. Finally, the present invention may be constructed from molded plastic and other molded materials so as to permit a substantially reduced cost of construction and marketing yet provide a device that is durable and may withstand being dropped without necessarily sustaining substantial damage so as to require replacement thereof.

The foregoing description and illustrative embodiments of the present invention have been shown in the drawings and described in detail in varying modifications and alternate embodiments. It should be understood, however, that the foregoing description of present invention is exemplary only, and that the scope of the present invention is limited only to the claims as interpreted and limited in view of the prior art.

I claim:

1. A beverage storage and dispensing device comprising:

a housing having top, bottom, front and rear surfaces which define width, depth and height dimensions;

liquid storage means disposed within said housing for storing a beverage including insulation means for maintaining the temperature of the beverage within said storage means;

inlet means for introducing the beverage into said storage means;

means for mounting said housing in an upright position; and means for selectively dispensing beverage from said storage means into a liquid receiver device including an orifice defined in the bottom surface of said housing and extending into said storage means, a closure plate mounted to the exterior of the bottom surface of said housing for slidingly moving along said bottom surface between a first position wherein said orifice is covered and a second position wherein said orifice is uncovered to permit selective passage of beverage by gravity flow therethrough, a detent projecting from the surface of said plate sized and shaped to fit within said orifice for sealing said orifice to prevent leakage when said closure plate is in said first position, bias means exterior to said main housing for urging said closure plate toward said first position, and trigger means projecting below said plate for selectively operating said closure plate in opposition to said bias means to permit flow of beverage through said orifice in said second position.

2. The device as claimed in claim 1, wherein said trigger means is adapted for operation by said liquid receiver device.

3. The device as claimed in claim 2, wherein said trigger means comprises a trigger member operatively connected to said closure plate, and a pair of spaced alignment tracks for orienting said liquid receiver device beneath said orifice to receive dispensed beverage.

4. The device as claimed in claim 3, wherein said trigger member comprises a ledge attached to and projecting downwardly from said closure plate and aligned substantially perpendicular to said spaced tracks, said ledge being sized and shaped to receive said liquid receiver device for movement between said tracks against said bias means to move said closure plate to said second position in response to movement of said liquid receiver device.

5. The device as claimed in claim 4, wherein said bias means is disposed against said ledge and is adapted for compression when said closure plate is moved toward said second position to urge said ledge and closure plate to said first position.

6. The device as claimed in claim 1, wherein said position maintaining means comprises at least one bracket projecting from the rear surface of said housing and including a lip portion projecting angularly downwardly therefrom.

7. The device as claimed in claim 6, wherein the length of said at least one bracket is adjustable relative to said housing.

8. The device as claimed in claim 1, wherein said position maintaining means comprises a mounting bracket having substantially parallel, spaced channels adapted for mounting to a surface, and a pair of shoulders projecting outwardly from the side edges of said housing top surface between said front and said rear surfaces for removable engagement with said channels.

9. The device as claimed in claim 1, wherein said closure plate comprises an elongated slide plate adapted for reciprocal longitudinal movement transversely to said width dimension of said housing and interconnected with said bias means to normally urge and maintain said slide plate in said first position flat against the bottom surface of said housing covering said orifice with said detent projecting therewithin.

10. The device as claimed in claim 9, wherein said detent includes sealant means disposed thereon to assist in preventing leakage.

11. The device as claimed in claim 9, wherein said bias means comprises a compression spring disposed within a cylinder mounted to the bottom surface of said housing.

12. The device as claimed in claim 11, wherein said slide plate is connected to said compression spring and mounted to said housing bottom surface for sliding movement therealong.

13. The device as claimed in claim 12, wherein said dispensing means further includes a pair of parallel alignment tracks disposed along said housing bottom surface, and a ledge member extending below said slide plate, said ledge member being sized and shaped for engagement with said liquid receiver device for activating said slide closure plate and moving said slide plate to said second position against said compression spring.

14. The device as claimed in claim 13, wherein said ledge member is non-linear in shape.

15. In a beverage storage and containing device having a housing defined by upper, bottom, and side surface portions, an interior chamber disposed within the housing, insulation means for maintaining the temperature of the beverage within said chamber, and means for dispensing beverage from said chamber into a liquid receiver, the improvement wherein said dispensing means comprises:

a beverage duct defined in the bottom surface portion of said housing and opening to the exterior surface thereof;

a closure plate mounted for reciprocal sliding movement along the exterior of said bottom surface portion between a first closure position covering said duct opening and a second open position wherein said duct opening is uncovered to permit passage of beverage therethrough to said liquid receiver;

a detent projecting from the surface of said closure plate sized and shaped to fit within said duct to prevent leakage when said closure plate is in its first closure position;

spring bias means for urging said closure plate toward said first position; and trigger means for sliding said closure plate to said second position in opposition to said spring bias means.

16. A beverage storage and dispensing device for use in moving vehicles such as automobiles and the like, said container comprising:

a housing having top, bottom, front and rear surfaces and a width dimension defined between said front and rear surfaces;

a liquid storage chamber disposed within said housing for storing a beverage including insulation surrounding said liquid storage chamber for maintaining the temperature of the beverage within said liquid storage chamber;

inlet means for introducing beverage into said liquid storage chamber;

means for mounting said housing in an upright position within a moving vehicle; and means for selectively dispensing beverage from said storage chamber into a liquid receiver device including an orifice defined in said housing bottom surface and extending into said liquid storage chamber, a slide closure plate mounted along the exterior of said housing bottom surface for reciprocally moving between a first position wherein said orifice is covered and a second position wherein said orifice is uncovered to permit selective passage of beverage by gravity flow therethrough, a detent projecting from the surface of said slide closure plate sized and shaped for fitting within said orifice to prevent leakage when said closure plate is in said first position, a compression spring for urging said closure plate toward said first position, and a trigger plate interconnected to said closure plate for selectively operating said closure plate in opposition to said compression spring to permit flow of beverage through said orifice in said second position, said trigger plate being adapted to engage a liquid receiver device and move in response to movement of said liquid receiver device against said trigger plate.

17. The device as claimed in claim 16, wherein said housing includes two said storage chambers disposed adjacent each other.

18. The device as claimed in claim 17, wherein said adjacent chambers are separated by an additional insulation layer disposed therebetween.

19. A beverage storage and dispensing device comprising:

a housing having top, bottom, front and rear surfaces;

liquid storage means disposed within said housing for storing a beverage including insulation means for maintaining the temperature of the beverage within said storage means, said storage means including a duct defined in the bottom portion thereof terminating in an orifice;

inlet means for introducing the beverage into said storage means;

means for maintaining said housing in an upright position; and means for selectively dispensing beverage from said storage means into a liquid receiver device including (a) an orifice defined in the bottom surface of said housing and extending into said storage means, said housing orifice being congruent with said duct orifice to funnel liquid therethrough, (b) an elongated slide member for slidingly moving between a first position wherein said orifice is covered and a second position wherein said orifice is uncovered to permit selective passage of beverage by gravity flow therethrough, (c) means for sealing said orifice to prevent leakage when said slide member is in said first position, said sealing means including a groove disposed in said housing bottom surface surrounding the exterior of said housing orifice and a resilient sealing member disposed in said groove projecting outwardly for firm contact with said slide member so as to seal said orifice and prevent leakage therefrom when said slide member is in its first, closed position, (d) bias means for urging said slide member toward said first position, said slide member being interconnected with said bias means to normally urge and maintain said slide member in said first position, and (e) trigger means for selectively operating said slide member in opposition to said bias means to permit flow of beverage through said orifice in said second position.

20. The device as claimed in claim 19, wherein said slide member includes an orifice defined therein and further comprises a collar projecting downwardly therefrom colinear with said slide member orifice to form a port to funnel liquid therethrough, said port being disposed so as to be aligned colinear with said storage means duct when said slide member is in its second position to provide a liquid tunnel for preventing leakage and spillage of said beverage when dispensed therethrough.

21. In a beverage storage and containing device having a housing with top, bottom, rear and front surfaces, an interior chamber having top, bottom and side portions, said chamber being disposed within the housing, insulation means for maintaining the temperature of the beverage within said container, and means for dispensing beverage from said chamber into a liquid receiver, the improvement wherein said dispensing means comprises:

a beverage duct defined in the bottom portion of said chamber and having an opening to the exterior of the bottom surface of said housing;

a closure member mounted for sliding movement between a first closure position covering said duct opening and a second open position wherein said duct opening is uncovered to permit passage of beverage therethrough to said liquid receiver;

a groove disposed in the bottom surface of said housing surrounding said duct opening;

a resilient member disposed in said groove projecting downwardly from said housing for firm contact with said closure member to seal said duct and prevent leakage therefrom when said closure member is in its first closure position;

spring bias means for urging said closure member toward said first position; and trigger means for sliding said closure member to said second position in opposition to said spring bias means.

22. The improvement as claimed in claim 21, wherein said closure member includes detent means disposed thereon for engagement with said duct when in said first position to prevent leakage therethrough, said detent means being movable from said duct in response to movement of said trigger means from said first to said second closure member position.

23. The improvement of claim 22, wherein said closure member includes an orifice defined therein and further comprises a collar projecting downwardly therefrom colinear with said closure member orifice to form a port to funnel liquid therethrough, said port being disposed so as to be aligned colinear with said interior chamber duct when said closure member is in its second position to provide a liquid tunnel for dispensing beverage without leakage and spillage.

24. A beverage storage and dispensing device for use in moving vehicles such as automobiles and the like, said container comprising:

a housing having top, bottom, front and rear surfaces;

at least one liquid storage chamber disposed within said housing for storing a beverage including insulation surrounding said chamber for maintaining the temperature of the beverage within said chamber, said storage chamber including a funnel-shaped duct defined in the bottom portion thereof terminating in an aperture;

inlet means for introducing the beverage into said storage chamber;

means for mounting said housing in an upright position within a moving vehicle; and means for selectively dispensing beverage from each said storage chamber into a liquid receiver device including (a) an orifice defined in the bottom surface of said housing and extending into a storage chamber, said orifice being congruent with said storage chamber aperture to funnel liquid therethrough, (b) a slide closure plate for reciprocally moving between a first position wherein said orifice is covered and a second position wherein said orifice is uncovered to permit selective passage of beverage by gravity flow therethrough, said closure plate including an orifice defined therein with a collar projecting downwardly therefrom colinear with said closure plate orifice to form a port to funnel liquid therethrough, said port being arranged so as to be colinear with said storage chamber duct when said closure plate is in its second position to provide a liquid tunnel for dispensing liquid therefrom without leakage and spillage, (c) means for sealing said orifice to prevent leakage when said closure plate is in said first position, said sealing means including a groove disposed in said housing bottom surface surrounding said housing orifice and a resilient member disposed in said groove and projecting outwardly therefrom for contact with said closure plate when in said first position to prevent leakage, (d) a spring bias member for urging said closure plate toward said first position, and (e) a trigger plate interconnected to said closure plate for selectively operating said closure plate in opposition to said spring bias member to permit flow of beverage through said orifice in said second position, said trigger plate being adapted to engage a liquid receiver device and move in response to movement of said liquid receiver device against said trigger plate.

25. The device as claimed in claim 24, wherein said housing includes two said storage chambers disposed adjacent each other.

26. The device as claimed in claim 25, wherein said adjacent chambers are separated by an additional insulation layer disposed therebetween.

* * * * *